United States Patent [19]

Meyer et al.

[11] 3,977,122

[45] Aug. 31, 1976

[54] DOLL ACCESSORIES

[75] Inventors: Burton C. Meyer, Downers Groove; Palmer J. Schoenfield, Evanston; Wayne Kuna, Oak Park, all of Ill.

[73] Assignee: Marvin Glass & Associates, Chicago, Ill.

[22] Filed: Apr. 25, 1975

[21] Appl. No.: 571,749

[52] U.S. Cl. ..... 46/130; 46/119; 46/133

[51] Int. Cl.[2] ..... A63H 13/12

[58] Field of Search ..... 46/116, 119, 130, 133, 46/134; 272/65, 68

[56] References Cited

UNITED STATES PATENTS

| | | | |
|---|---|---|---|
| 2,969,124 | 1/1961 | Nissen | 272/65 |
| 3,701,215 | 10/1972 | Marason et al. | 46/130 |
| 3,752,473 | 8/1973 | La Lanne | 272/68 |
| 3,862,513 | 1/1975 | Isaacson | 46/119 |

*Primary Examiner*—Louis G. Mancene
*Assistant Examiner*—Robert F. Cutting
*Attorney, Agent, or Firm*—Coffee & Sweeney

[57] ABSTRACT

An accessory set of gymnasium equipment for use with a figure toy, including a trampoline, a chinning bar, a set of rings, a balancing beam, a weight set and exercise rack, a pair of uneven parallel bars, a balancing or vault horse, and an exercise mat. The various components such as the trampoline, rings and chinning bar include many interchangeable parts which provide a variety of functions while conserving space and materials. Preferably the figure toy will have hands, e.g., flexible, which are capable of grasping so as to enable the figure toy to be supported on a bar or the like by the friction generated by the flexure of the hands. A retaining belt or waistband is provided to assist in balancing the figure toy while using the trampoline accessory.

12 Claims, 14 Drawing Figures

Fig 7
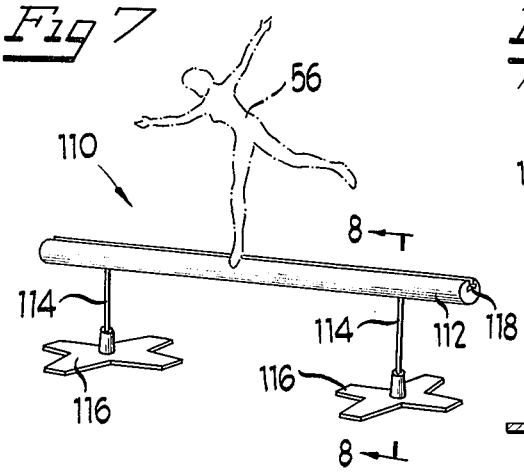
Fig 8
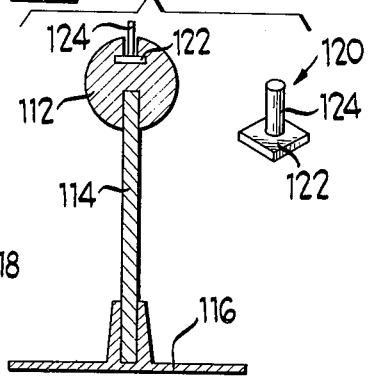
Fig 10
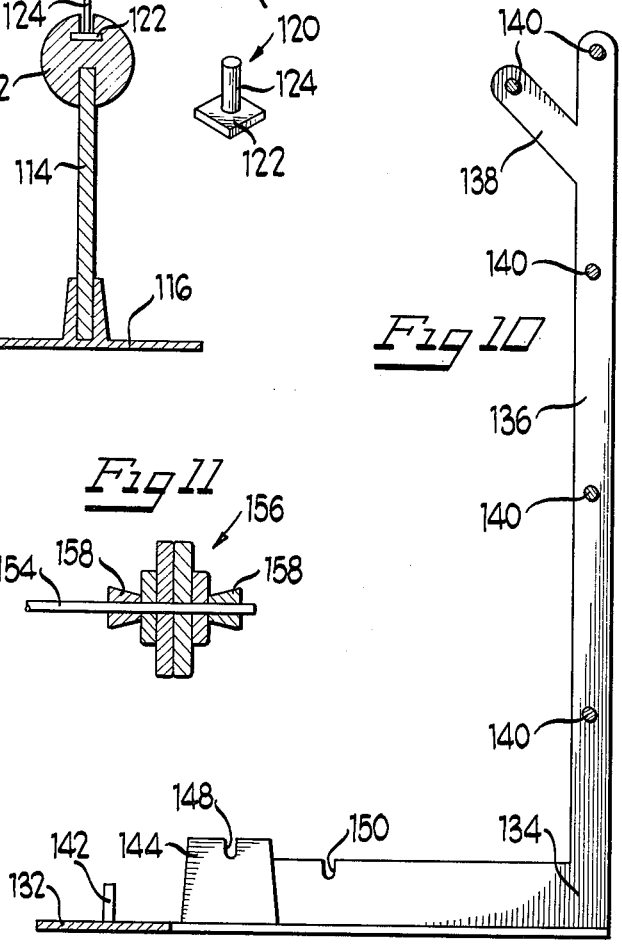
Fig 9
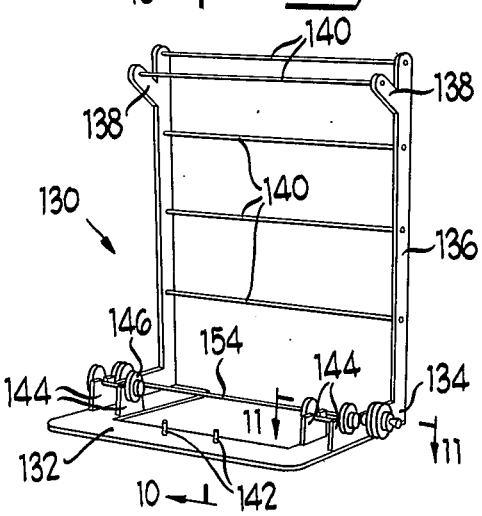
Fig 11
Fig 12
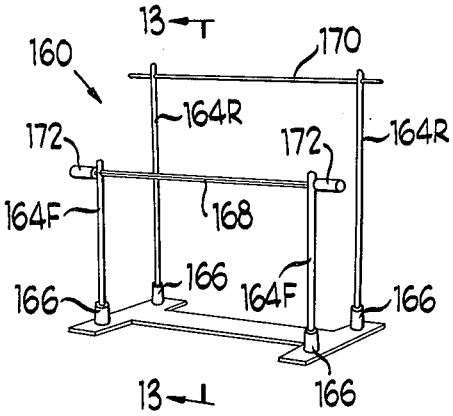
Fig 13
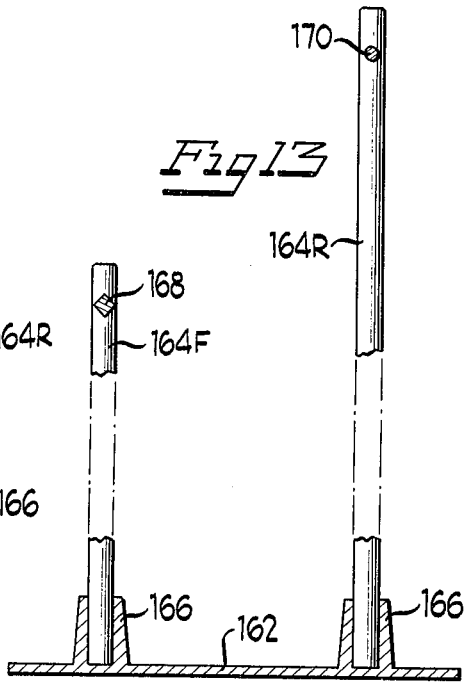
Fig 14
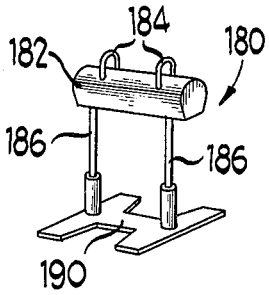

DOLL ACCESSORIES

BACKGROUND OF THE INVENTION

1. Field of the Invention

This invention relates generally to accessories for use with figure toys and in particular to a set of miniature gymnastic equipment for use with a figure toy.

2. Description of the Prior Art

In the past, accessories for figure toys, such as trucks, military equipment, camping equipment and the like have been provided for figure toys and have been well received by the public. However, most accessories of this type, where a child takes an active, participating interest with the figure toy, have been directed mainly towards male figure toys while those intended for use with female figure toys were generally of a passive nature such as doll clothing and the like.

SUMMARY OF THE INVENTION

It is an object of the present invention to provide a gymnastic set of accessories which is readily adaptable for use with figure toys.

Other objects, features and advantages of the invention will be apparent from the following detailed description taken in connection with the accompanying drawings.

The present mode currently contemplated for carrying out the invention includes the provision of a set of gymnastic equipment for use with a figure toy, including a trampoline, chinning bar, ring set, balancing bar, weight set and exercise rack, uneven parallel bars, a balancing or vault horse and an exercise mat.

BRIEF DESCRIPTION OF THE DRAWINGS

FIG. 7 is a perspective view of the balancing beam accessory of the present invention;

FIG. 8 is a vertical section, on an enlarged scale, of the balancing beam accessory, taken generally along line 8—8 of FIG. 7, and including a perspective view of the figure toy T-support member;

FIG. 9 is a perspective view of the weight set and exercise rack accessory of the present invention;

FIG. 10 is a vertical section, on an enlarged scale, of the exercise rack, taken generally along line 10—10 of FIG. 9;

FIG. 11 is a fragmented vertical section, on an enlarged scale, taken generally along line 11—11 of FIG. 9;

FIG. 12 is a perspective view of the uneven parallel bar accessory of the present invention;

FIG. 13 is a vertical section, on an enlarged scale, taken generally along line 13—13 of FIG. 12; and FIG. 14 is a perspective view of the exercise horse accessory of the present invention.

DESCRIPTION OF THE PREFERRED EMBODIMENT

Figure 1:
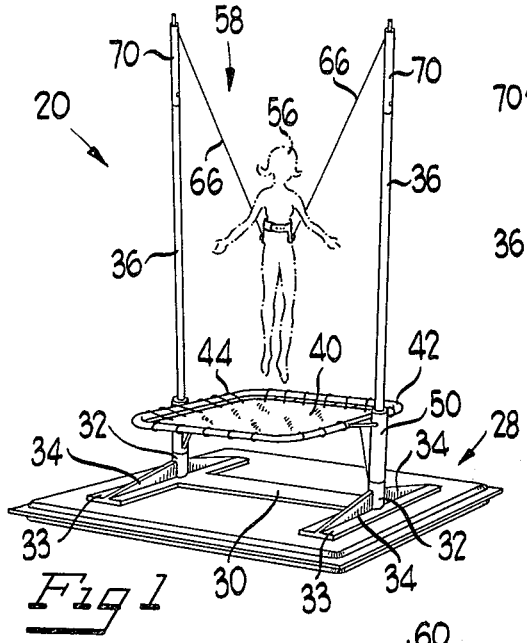
FIG. 1 is a perspective view of the figure toy trampoline accessory of the present invention, positioned on a resilient flexible mat.
Figure 2:
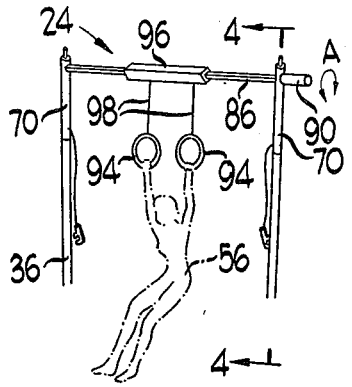
FIG. 2 is a fragmented perspective view of the ring set accessory of the present invention.
Figure 3:
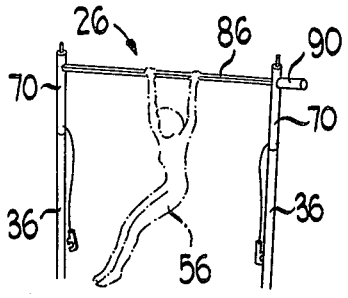
FIG. 3 is a fragmented perspective view similar to FIG. 2 of the chinning bar accessory of the present invention.

FIG. 1 shows a figure toy accessory in the form of a trampoline, generally designated 20, part of which is used in conjunction with a ring set accessory, generally designated 24 (FIG. 2), and a chinning bar accessory, generally designated 26 (FIG. 3).

The trampoline accessory of FIG. 1 is shown mounted on a resilient exercise mat, generally designated 28. The trampoline accessory 20 includes an H-shaped base 30 having an upstanding sleeve 32 supported at the midpoint of each cross arm 33 of the H-shape by a pair of triangular upstanding flanges 34. Each sleeve 32 mounts a generally vertical support post 36 on each side of the base 30, as shown in FIG. 1. A sheet of flexible material 40 is resiliently supported in a generally rectangular frame 42 by a continuous strand 44 of flexible material which is successively wrapped around the frame 42 and inserted through spaced holes 46 (FIG. 5) in the material 40 to define the resilient trampoline area. The frame 42 is connected on opposite sides to an elongated sleeve section 50 (FIGS. 4 and 5) by a triangular horizontal flange 52 and a unitary triangular vertical flange 54. The sleeves 50 thus are spaced apart to slidably embrace the support posts 36 in abutment on top of sleeves 32 so as to support the trampoline area 40 above the base 30.

Figure 6:
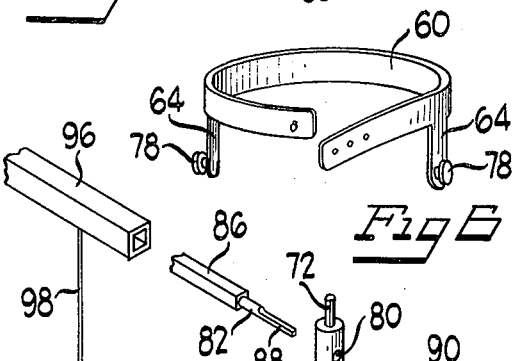
FIG. 6 is a perspective view, on an enlarged scale, of a waistband for the trampoline accessory shown in FIG. 1.

Since the trampoline 20 is designed to be used in conjunction with a figure toy 56 (as shown in phantom in FIG. 1), it is desirable to include restraining means, generally designated 58, to prevent the figure toy 56 from flying off the boundaries of the trampoline area defined by sheet 40. The restraining means 58 includes a waistband 60 (FIG. 6) which can be secured about the torso of the figure toy 56 and connected by a buckle, generally designated 62 (FIG. 6). The waistband 60 includes a depending tab 64 on either side thereof for connecting the waistband 60 and thus the figure toy 56 to a pair of support lines 66 (FIG. 1). The support lines 66 are connected at one end to an invertible support post extension 70. The invertible post extension 70 carries a reduced end or pin 72 on each end thereof which is adapted to engage a hole 74 in the top of each support post 36. A clip 76 (FIGS. 4 and 5) is provided on the free end of the support line 66 and provides a snap fit over a pair of studs 78 (FIG. 6) provided on the depending tabs 64 of the waistband 60. Thus the figure toy can be mounted and secured in the waistband and caused to reciprocate or jump up and down on the trampoline area 40 by a child using the accessory 20, the figure toy being retained by the lines 66. In practice, it has been found that the use of flexible material for the retaining lines 66 provides a more realistic and life-like appearance as the figure toy reciprocates upon the trampoline area 40.

Figure 4:
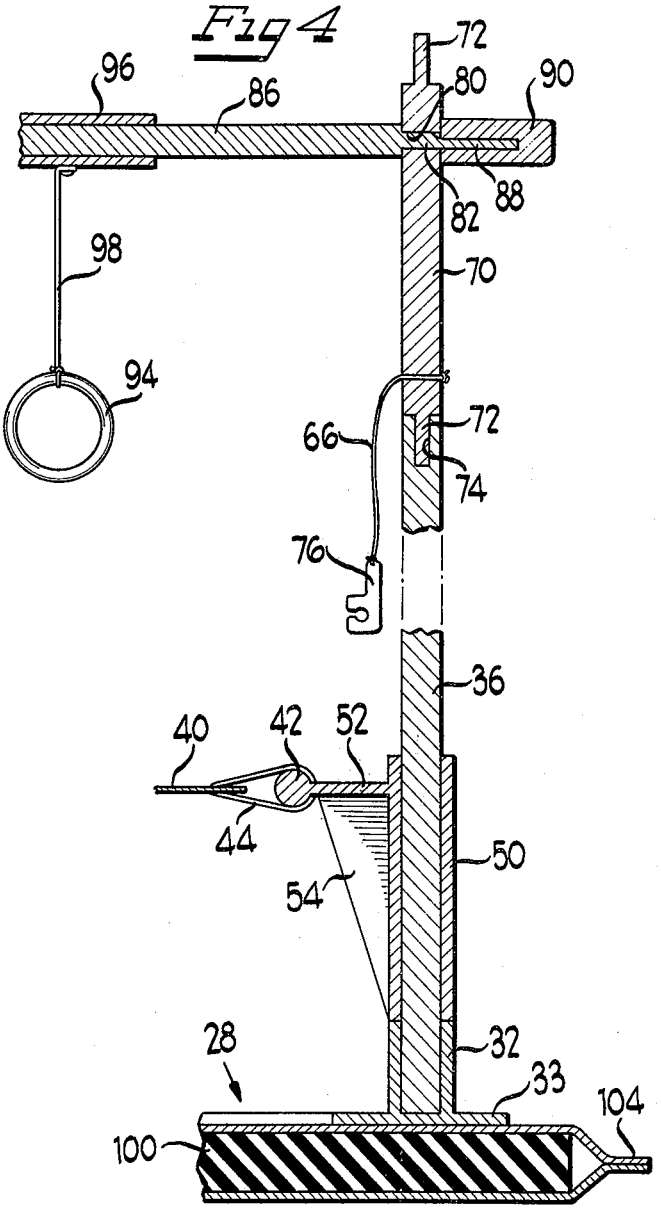
FIG. 4 is a fragmented, vertical section, on an enlarged scale, of the ring set and trampoline supports, taken generally along line 4—4 of FIG. 2.
Figure 5:
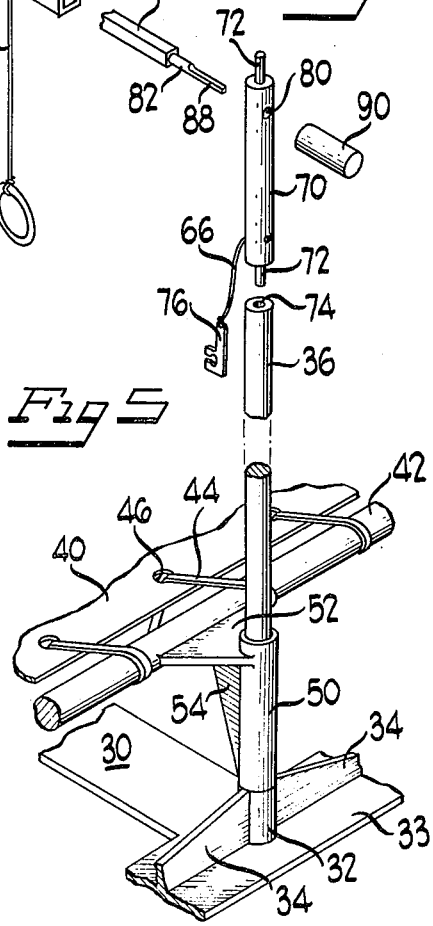
FIG. 5 is an exploded, fragmentary perspective view of the ring set and trampoline supports of FIG. 4.

FIGS. 2, 4 and 5 show the use of the basic support structure with the ring set 24. More particularly, the invertible support post extensions 70 are removed from the posts 36 and the top ends thereof are reinserted into the hole 74 in the top of the support posts. As seen in FIGS. 4 and 5, a journal 80 is provided in each extension 70 for rotatably mounting the reduced ends 82 of a generally square crossbar 86. One of the reduced ends 82 includes a keyed extension 88 (see FIG. 5) which extends through the journal 80 for supporting a thumbwheel or handle 90 for conjoint rotation with the crossbar 86.

The ring set 24 includes a pair of rings 94 which are fastened to a section of rectangular tubing 96 by rigid connecting arms 98. The crossbar 86 is inserted into the tubular section 96 prior to mounting between the extension supports 70 and will be caused to rotate as the thumbwheel 90 is manually rotated. As seen in FIG. 2, a figure toy 56 which is provided with graspable hands will be supported by the rings 94 and be caused to rotate about the axis of the crossbar 86 as the thumbwheel 90 is rotated in either direction as shown by arrow A in FIG. 2. Thus the figure toy will appear to "swing" with the ring set 24.

Similarly, the crossbar 86 may be used without the ring set 24 and the graspable hands of the figure toy may simply be attached to the crossbar to simulate a gymnast practicing on a bar or performing other exercises as the crossbar is rotated by the thumbwheel or handle 90.

The exercise mat 28 can be seen more clearly in FIG. 4. The mat includes an internal resilient filler 100, such as foam rubber or the like, which is encased in a flexible covering and sealed around the perimeter as at 104. An articulated figure toy can be placed on the mat and manually made to perform thereon. Of course, the supports of FIGS. 1–5 need not be placed on top of the mat, as shown.

A balancing beam, generally designated 110, embodying the concepts of the present invention, is shown in FIGS. 7 and 8. The balancing beam 110 includes a generally circular, horizontally disposed beam 112 which is mounted above the ground or other surface by a pair of upstanding supports 114 mounted in cross-shaped bases 116. The beam 112 includes a T-slot 118 along its entire length having the leg of the "T" extending generally vertically. A T-shaped support member, generally designated 120, is shown in perspective in FIG. 8 and fits within the T-slot 118. The T-support member includes a flat plate 122 having an upstanding pin 124 secured thereon or molded integrally therewith so that as the plate 122 is inserted into the base of the T-slot 118, the upstanding pin 124 extends above the upper surface of the balancing beam 112. A figure toy 56 is mounted to the T-support 120 by a friction fit between apertures or recesses in the feet of the figure toy and the pin 124 and will be "balanced" on the beam and can be moved longitudinally to any point along the beam. An articulated figure toy 56 may be used with the extremities thereof oriented in any direction, since it is not necessary for the center of gravity of the figure toy 56 to be vertically above the axis of the balancing beam 112.

A set of weights and an exercise rack, generally designated 130, is shown in FIG. 9 to include a flat U-shaped base 132 supported a pair of L-shaped flanges 134 each having a substantially elongated upstanding portion 136. A canted extension arms 138 extends generally forwardly and upwardly to form a Y portion at the top of the extension 136. A plurality of crossbars 140 are mounted between the vertical supports 136 and 138 for performing climbing or other exercising functions. A pair of generally vertically extending pins 142 are provided on the top front of the U-shaped base portion 132 for supporting and frictionally engaging apertures or recesses provided in the feet of the figure toy (not shown). A pair of smaller upstanding flanges 144 are provided on each leg of the base 132 for supporting a small dumbbell 146 in a journal 148 formed in each flange 144. A similar pair of journals 150 are provided in the flanges 134 rearwardly of the flanges 144 for supporting a barbell 154. One end of the barbell 154 is seen in FIG. 11 to include a plurality of removable weights 156. Each weight includes an aperture in the center thereof for the introduction of the barbell shaft. At least the outermost weights 158 snugly fit the shaft 154 to prevent the weights 156 from falling off or sliding inwardly.

An uneven parallel bar set, generally designated 160, is shown in FIG. 12. The set 160 includes a flat H-shaped base 162 having a plurality of support posts mounted in sleeves 166 in each extremity of the base 162. A pair of forwardmost posts 164F are substantially shorter than rearward posts 164R and include an upper journal similar to that shown in FIG. 4 for rotatably supporting a front parallel bar 168 having a generally square cross section. The rear parallel bar 170 has a substantially circular cross section and is not necessarily rotatably mounted in the posts 164R. The forward crossbar 168 includes a thumbwheel or handle 172 on each end thereof to facilitate rotation of the crossbar 168 and thus rotation of a figure toy (not shown) attached thereto similar to that shown in FIG. 3.

An exercise horse or vault, generally designated 180, is shown in FIG. 14. The exercise horse 180 includes an enlarged horizontal beam 182 having a pair of generally U-shaped handles 184 extending upwardly therefrom. The beam 182 is mounted by a pair of vertical support posts 186 on a suitable H-shaped base 190. The handles can be grasped by flexible hands of the figure toy, and can be removed to convert the exercise horse into a vault.

One form of articulated figure toy for use with the accessories of the present invention is shown in U.S. Pat. No. 3,862,513 which is assigned to the assignee of the present invention, the disclosure of which is incorporated herein by reference. Briefly, as shown therein, the doll is fully jointed and widely articulated, and includes the aforesaid graspable hands as well as the aforesaid recesses or apertures in the feet of the doll.

The foregoing detailed description has been given for clearness of understanding only and no unnecessary limitations should be understood therefrom as some modifications will be obvious to those skilled in the art.

We claim:

1. A trampoline accessory for use with a figure toy, comprising:

an upright support structure;

a trampoline device, including a sheet of flexible material, mounted on said upright support structure substantially below the top thereof; and elongated flexible support means secured at one end to said upright support structure above the trampoline device and having engaging means at the opposite end therefor for securing to a figure toy to guide the figure toy as it is bounced off of the trampoline device.

2. The accessory of claim 1 wherein said upright support structure includes at least a pair of upright supports one on opposite sides of the trampoline device, and said elongated flexible support means includes a pair of support lines one between each of the upright supports and said engaging means.

3. The accessory of claim 2 wherein said support lines are resilient.

4. The accessory of claim 1 wherein said engaging means includes an adjustable waistband for embracing the torso of the figure toy.

5. The accessory of claim 2 including a crossbar rotatably mounted between the pair of upright supports and graspable by the figure toy; and means for selective manual rotation of said crossbar to cause the figure toy to rotate about the axis of the crossbar as the crossbar rotates.

6. The accessory of claim 5 wherein the crossbar has a generally square cross section.

7. The accessory of claim 5 including a pair of rings and means for securing the rings to and spaced from said crossbar whereby the figure toy may grasp the rings to swing about the axis of the crossbar in response to manual rotation thereof.

8. An exercise bar accessory for use with a figure toy having graspable hand portions, comprising:

a base having a pair of spaced upstanding supports;

a crossbar rotatably mounted between said upright supports;

means for selective manual rotation of said crossbar whereby the hands of the figure toy may grasp the crossbar to cause the figure toy to rotate about the axis of the crossbar as the crossbar is manually rotated; and a pair of rings and means for securing the rings to and spaced from said crossbar whereby the figure toy may grasp the rings to swing about the axis of the crossbar in response to manual rotation thereof.

9. The accessory of claim 8 wherein said securing means comprise rigid arms.

10. An exercise bar accessory for use with a figure toy having graspable hand portions, comprising:

a base having a pair of spaced upstanding supports;

a crossbar rotatably mounted between said upright supports, said crossbar being sufficiently large in cross-section so as to provide a relatively tight fit with the hand portions of the figure toy and being irregularly shaped in cross section providing ridges longitudinally along the crossbar with generally flat sides between the ridges for engagement of the crossbar with the hand portions to facilitate frictional engagement therewith; and means for selective manual rotation of said crossbar whereby the hands of the figure toy may grasp the crossbar to cause the figure toy to rotate about the axis of the crossbar as the crossbar is manually rotated.

11. The accessory of claim 10 including a second crossbar mounted on the base spaced from said first crossbar in a parallel relationship thereto to provide an exercise set of parallel bars.

12. The accessory of claim 11 wherein said second crossbar is mounted at a higher elevation than said first crossbar to provide a set of uneven parallel bars.

* * * * *